US007791002B2

(12) United States Patent
Muska et al.

(10) Patent No.: US 7,791,002 B2
(45) Date of Patent: Sep. 7, 2010

(54) BATTERY POWERED CIGARETTE LIGHTER AND PROCESS FOR USING THE SAME

(75) Inventors: David W. Muska, Lorain, OH (US); Jean-Francois Audebert, Westlake, OH (US); Peter F. Hoffman, Avon, OH (US)

(73) Assignee: Eveready Battery Company, Inc., St. Louis, MO (US)

( * ) Notice: Subject to any disclaimer, the term of this patent is extended or adjusted under 35 U.S.C. 154(b) by 1416 days.

(21) Appl. No.: 11/208,702

(22) Filed: Aug. 22, 2005

(65) Prior Publication Data

US 2007/0042305 A1 Feb. 22, 2007

(51) Int. Cl.
*F23Q 7/00* (2006.01)
*F23Q 7/06* (2006.01)

(52) U.S. Cl. ..... 219/268; 431/258

(58) Field of Classification Search ..... 219/268, 219/260–270; 431/258–266
See application file for complete search history.

(56) References Cited

U.S. PATENT DOCUMENTS

| | | | | |
|---|---|---|---|---|
| 2,199,885 | A | 5/1940 | Kravchuk | |
| 2,240,678 | A | 5/1941 | Stanard | |
| 2,459,656 | A | 1/1949 | Kirschner | |
| 2,516,843 | A | 8/1950 | Bakst et al. | |
| 2,535,665 | A | 12/1950 | Boyasky et al. | |
| 2,676,237 | A | 4/1954 | Tooker, Jr. | |
| 2,689,902 | A | 9/1954 | Burtman | |
| 2,729,736 | A | 1/1956 | Perez | |
| 2,897,336 | A | 7/1959 | Taber | |
| 3,277,271 | A | 10/1966 | Hunt | |
| 3,392,265 | A | 7/1968 | King et al. | |
| 4,342,902 | A * | 8/1982 | Ping | 219/268 |
| 4,947,874 | A | 8/1990 | Brooks | |
| 5,144,962 | A | 9/1992 | Counts | |
| 5,221,820 | A | 6/1993 | Shimoji | |
| 5,235,157 | A | 8/1993 | Blackburn | |
| 5,268,553 | A | 12/1993 | Shimoji | |
| 5,274,214 | A * | 12/1993 | Blackburn | 219/268 |
| 5,354,968 | A * | 10/1994 | Yamamura | 219/268 |
| 5,649,554 | A | 7/1997 | Sprinkel et al. | |
| 5,750,964 | A | 5/1998 | Counts et al. | |
| 5,934,289 | A | 8/1999 | Watkins et al. | |
| 6,040,560 | A | 3/2000 | Fleischhauer et al. | |
| 6,784,403 | B2 * | 8/2004 | Abe et al. | 219/267 |
| 6,803,545 | B2 | 10/2004 | Blake et al. | |
| 7,138,605 | B1 * | 11/2006 | Smith | 219/268 |
| 2003/0226837 | A1 | 12/2003 | Blake et al. | |
| 2004/0089314 | A1 | 5/2004 | Felter et al. | |

FOREIGN PATENT DOCUMENTS

| | | | |
|---|---|---|---|
| DE | 3322227 | A1 | 1/1985 |
| JP | 07019473 | A | 1/1995 |

* cited by examiner

*Primary Examiner*—Daniel Robinson
(74) *Attorney, Agent, or Firm*—Gregory J. Adams

(57) ABSTRACT

A battery powered cigarette lighter having a switch which is activated by a change in air pressure or air flow is described. The change in air pressure or air flow, which is caused by the consumer forcing air through the air permeable cigarette, causes the switch to close thereby allowing the lighter's direct current power supply to increase the temperature of the lighter's heating element above the cigarette's ignition point.

48 Claims, 5 Drawing Sheets

BATTERY POWERED CIGARETTE LIGHTER AND PROCESS FOR USING THE SAME

BACKGROUND OF THE INVENTION

This invention generally relates to portable handheld lighters. More particularly, this invention is concerned with battery powered lighters for cigars and cigarettes.

Conventional cigarette lighters are used by consumers to ignite the tobacco in one end of a cigarette as the consumer forces air through the cigarette by inhaling. While many different devices and sources of heat could be used to ignite a cigarette, three of the most common ways to ignite a cigarette include using: a match; a coil that has been heated by passing an electric current through the coil; and a flame that is powered by a flammable liquid such as butane which is stored in a portion of the lighter. Unfortunately, all three of these devices can be used to ignite materials other than cigarettes or cigars. The match and flammable liquid lighter are considered to be particularly dangerous because both devices produce "open flames" which can be used, either intentionally or unintentionally, to ignite a wide range of flammable materials. In addition to the dangers associated with matches and electrically heated coils, lighters that contain a reservoir housing a flammable liquid are known to be especially dangerous because of the risk that the flammable liquid will be removed from the lighter and used in an illegal and destructive manner.

To reduce or eliminate the risks associated with using an open flame lighter, various attempts have been made to provide a lighter that will ignite a cigarette without using an open flame. For example, U.S. Pat. No. 5,268,553 discloses a battery powered lighter that uses a laser to ignite the tobacco. In another example, U.S. Pat. No. 5,235,157 discloses a battery powered lighter that uses a spiral electric heating element to elevate the temperature of the tobacco to ignite the cigarette. The same patent discloses a recessed opening into which the cigarette must be inserted to enable the heating element to contact the cigarette. The recessed opening is intended to inhibit the intentional setting of fires. Unfortunately, neither of these inventions is able to effectively limit the use of the lighter to igniting tobacco in a cigarette.

Therefore, there exists a need for a cigarette lighter that will effectively ignite the tobacco in a cigarette but cannot be used to ignite other materials such as a flammable liquid, strips of paper or a candle's wick.

BRIEF SUMMARY OF THE INVENTION

The present invention provides a portable battery powered lighter that will effectively and efficiently ignite a cigarette but cannot be used to ignite many other materials.

In one embodiment, the present invention is an apparatus that includes a housing and an electrical circuit disposed in the housing. The housing defines an opening therein. The circuit includes a heating element, a direct current power supply that provides an electrical current to the heating element, and a switch for regulating the flow of the electrical current to the heating element. The switch is activated by a change of air pressure within the housing.

In another embodiment, the present invention also relates to an apparatus that includes a housing and an electrical circuit disposed in the housing. The housing defines an opening therein. The circuit includes a heating element, a direct current power supply that provides an electrical current to the heating element, and a switch for regulating the flow of the electrical current to the heating element. The switch is activated by a change in air flow within the housing.

The present invention also relates to a process for igniting a cigarette. The process includes the following steps. Providing an apparatus comprising a housing and an electrical circuit disposed within the housing. The housing defines an opening therein. The circuit comprises a heating element, a direct current power supply providing an electrical current to the heating element, and a switch for regulating the flow of the electrical current to the heating element. The switch is activated by a change in air pressure within the housing. Providing an elongated, air permeable cigarette having a first end and a second end. Inserting the first end of the cigarette into the opening in the housing. Igniting the cigarette by causing a change in air pressure within the housing which activates the switch that allows the electrical current from the direct current power supply to increase the temperature of the heating element. Withdrawing the cigarette from the housing.

The present invention also relates to yet another process for igniting a cigarette. The process includes the following steps. Providing an apparatus comprising a housing and an electrical circuit disposed within the housing. The housing defines an opening therein. The circuit comprises a heating element, a direct current power supply providing an electrical current to the heating element, and a switch for regulating the flow of the electrical current to the heating element. The switch is activated by a change in air flow within the housing. Providing an elongated, air permeable cigarette having a first end and a second end. Inserting the first end of the cigarette into the opening in the housing. Igniting the cigarette by causing a change in air flow within the housing which activates the switch that allows the electrical current from the direct current power supply to increase the temperature of the heating element. Withdrawing the cigarette from the housing.

DETAILED DESCRIPTION OF THE INVENTION

As used herein the term "cigarette" generally refers to an elongated, rolled tube that contains tobacco or other similar products. A sheet of coiled paper may be used to contain the tobacco. The cigarette has a first end, a second end, and is air permeable. The second end may contain a filter. At least the first end contains tobacco that can be ignited. The cigarette is considered to be air permeable if an individual can manually draw air into the first end, through the length of the cigarette, and out the second end.

Figure 1:
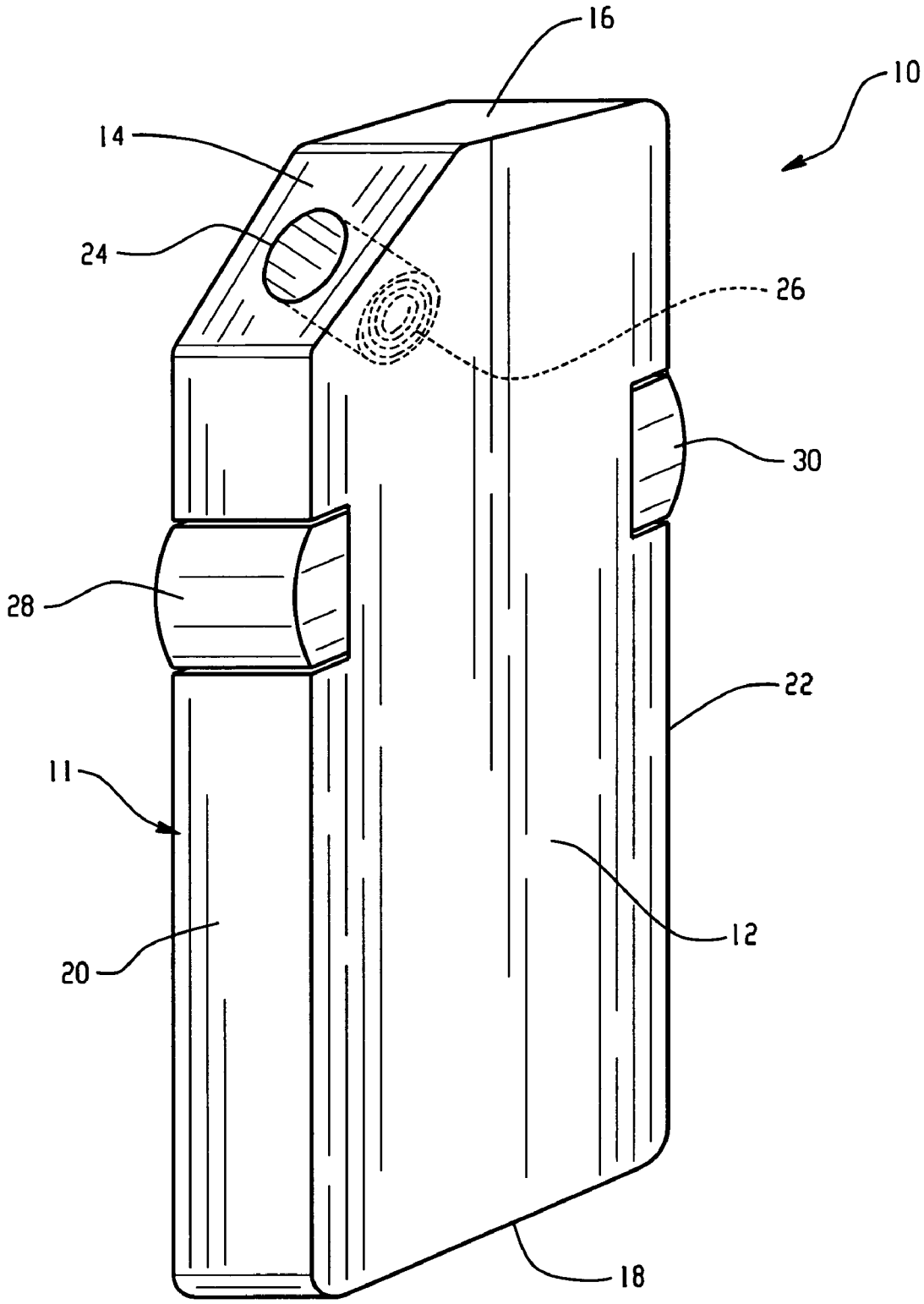
FIG. 1 is a perspective view of battery powered cigarette lighter of the present invention.

Referring now to the drawings and more particularly to FIG. 1, there is shown a perspective view of a cigarette lighter 10 of this invention. Lighter 10 has a generally rectangular housing 11 that includes first surface 12, second surface 14, third surface 16, fourth surface 18, fifth surface 20, sixth surface 22 and recessed opening 24. Heating element 26 is disposed within the recessed opening. First manual switch 28 is incorporated into fifth surface 20 which may also be described herein as the leading edge. Second manual switch 30 is incorporated into sixth surface 22 which may be referred to herein as the trailing edge. Manual switches 28 and 30 are located on opposite sides of the housing at approximately the same distance from fourth surface 18 to facilitate simultaneous pressing of both switches between a consumer's thumb and index finger. The rectangular housing is sized to easily fit into a consumer's pocket or purse. If desired, the housing could be adapted to hang from a key chain.

Figure 2:
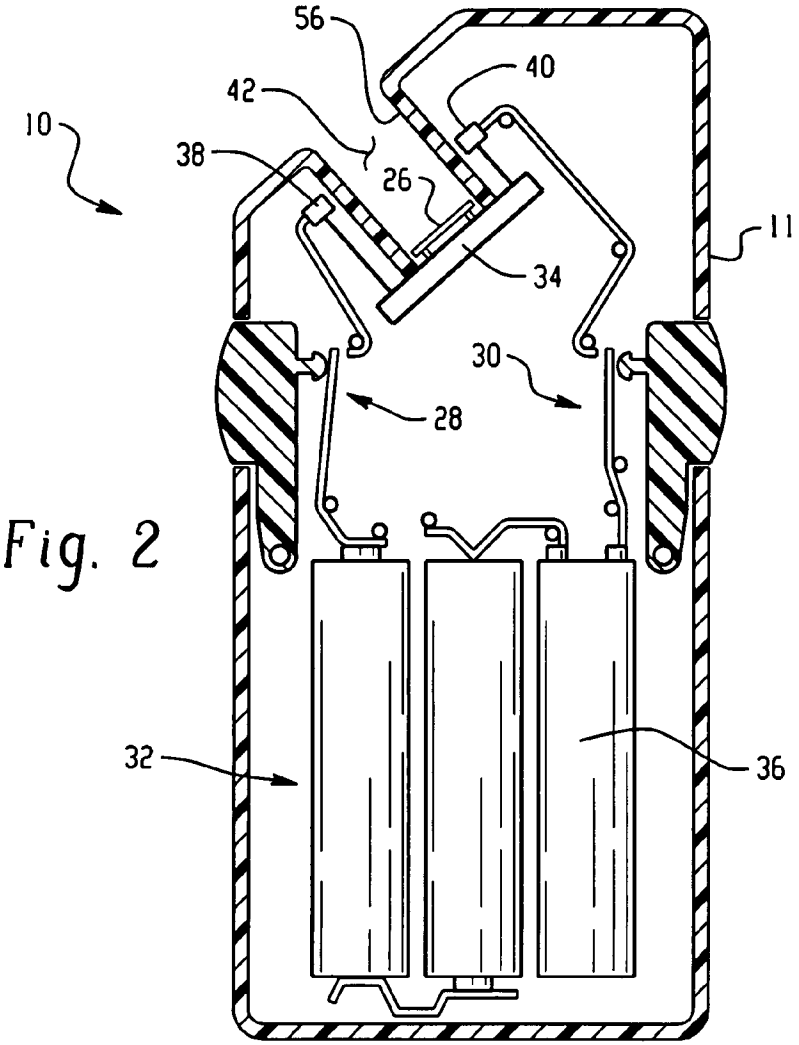
FIG. 2 is a cross-sectional view of a first embodiment of a battery powered cigarette lighter of the present invention.

FIG. 2 is a cross-sectional view of a first embodiment of a lighter of this invention. Lighter 10 includes housing 11 and an electrical circuit disposed therein. The electrical circuit includes heating element 26, a direct current power supply 32, and at least one switch 34 that regulates the flow of electrical current from the power supply to the heating element. Switch 34 is activated by a change of air pressure within the housing. The word "activated", as used herein, means that the switch is electrically closed thereby allowing an electric current to pass through the circuit. Switch 34 is preferably located adjacent cavity 42 and is activated by a change in air pressure within the housing. Preferably, the change in air pressure occurs after the consumer inserts the first end of a cigarette into cavity 42 and then manually draws air through the length and second end of the cigarette by inhaling while sealing their lips against the second end of the cigarette. Alternatively, the change in air pressure could be caused by changing the altitude of the lighter as will be explained below with reference to FIG. 4. The negative pressure created by the consumer inhaling air through the cigarette immediately activates switch 34 which allows an electrical current to pass through the heating element. The temperature of the heating coil rises rapidly until it exceeds the ignition temperature of the tobacco. After the tobacco begins to burn, the consumer stops inhaling thereby terminating the negative pressure detected by switch 34 and causing an electrical disconnect in the circuit which turns the lighter "off".

In an alternative embodiment, switch 34 can be activated by the exertion of positive air pressure. For example, after the first end of the cigarette has been inserted into the cavity, the consumer can activate switch 34 by manually forcing air from the second end of the cigarette to the first end of the cigarette which exerts a positive pressure on switch 34. As long as switch 34 is activated, an electrical current flows to the heating element which becomes sufficiently hot to ignite the tobacco.

The advantage of using a cigarette lighter with a switch that is responsive to a change in air pressure within the housing of the lighter is that the lighter can only be activated when an air permeable article, such as a cigarette or cigar, is inserted into the cavity and the switch detects the change in air pressure. If a solid object, such as a candle's wick or match, is inserted into the cavity, the lighter will not ignite the wick or match because the consumer cannot close switch 34. Similarly, if the lighter's heating element is allowed to contact flammable fumes or a flammable liquid, the element will not become hot because the consumer cannot exert pressure on switch 34. Consequently, the lighter of this invention is inherently limited to igniting objects that are sufficiently air permeable to allow the consumer to exert air pressure on a switch that is enclosed within the housing. Accidental activation of the lighter while it is stored in a purse or backpack is virtually precluded by the design of the lighter. Similarly, intentionally burning any material in an illegal manner is effectively thwarted by the existence of the switch which can only be activated by exerting air pressure on the switch which is protected by the housing.

Figure 3:
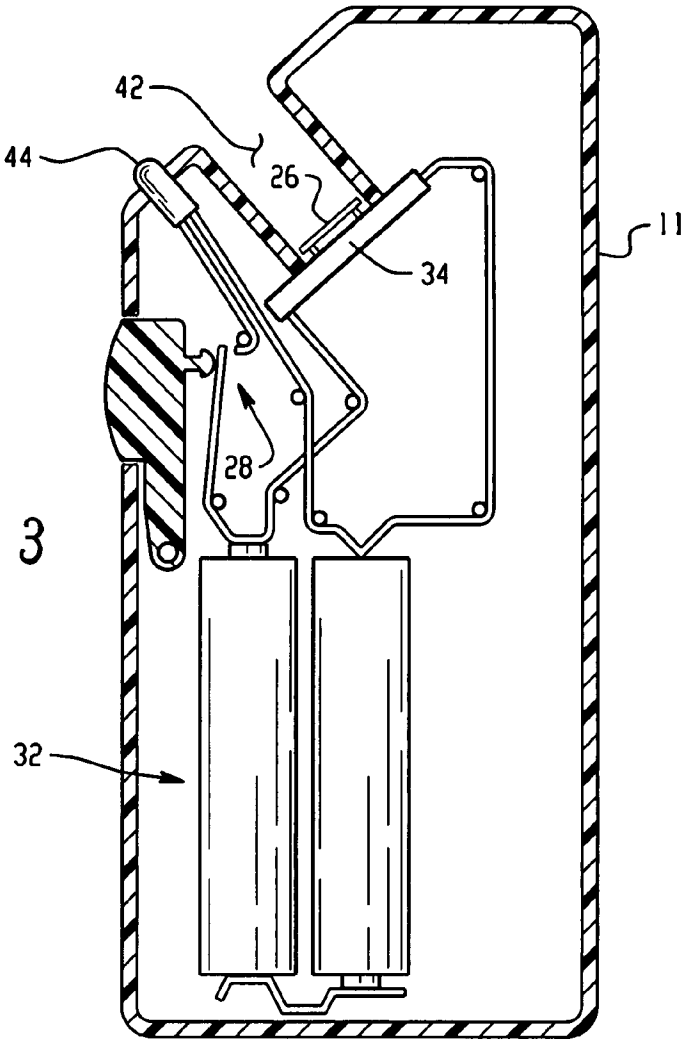
FIG. 3 is a cross-sectional view of a second embodiment of a battery powered cigarette lighter of the present invention.

To further improve the safety of the lighter, the circuit disposed within the housing may also contain components such as first manual switch 28, second manual switch 30, energy storage system 36, proximity sensor 38 and a positive temperature coefficient switch 40. As shown in FIG. 3, a suitable lighter could contain a single manual switch, such as first manual switch 28, in addition to air pressure activated switch 34. The first manual switch could be used to complete an electrical circuit between the power supply and an illuminating element 44 such as a light emitting diode (LED) or an incandescent bulb. The LED could be made to illuminate the area beyond the lighter's housing thereby facilitating easy location of the cavity and insertion of a cigarette into the lighter during low or no ambient light lighting conditions. Although not shown in FIG. 3, the LED could also be made to illuminate the cavity into which the cigarette is inserted. If desired, a lighter with an illuminating element incorporated therein could be used as a conventional flashlight by configuring a switching mechanism that would provide electrical current to the LED or incandescent bulb but not to the heating element.

Referring again to FIG. 2, a suitable lighter could contain a first manual switch 28 and a second manual switch 30. Simultaneous closing of both switches would be needed to complete the lighter's electrical circuit. The use of double activation manual switches and the air pressure activated switch would further deter accidental activation of the lighter by unauthorized individuals such as young children who might try to imitate an adult igniting a cigarette.

Energy storage system 30, which could be a capacitor, super capacitor or a rechargeable battery, is an optional component that could be used to provide a burst of electrical energy to insure reliable operation of the lighter in adverse conditions such as extreme cold, damp or windy conditions. For example, if a consumer is attempting to ignite a cigarette while camping outdoors during the winter, the cigarette lighter's heating element may need to receive an abnormally large amount of electrical current to sufficiently heat the cold tobacco above the ignition point. To facilitate delivering a large burst of electrical current, the consumer would close at least one of the manual switches which would allow electrical energy from the power supply to charge the energy storage system. An indicating light, such as a green LED (not shown) could be used to notify the consumer that the energy storage system is ready to ignite the cigarette. Upon seeing the illumination of the green LED, the consumer would insert the first end of the cigarette into the lighter's cavity, exert a negative pressure on the air pressure switch in the housing by inhaling through the cigarette which would subsequently cause the heating element to become hot and ignite the tobacco.

Another safety feature is proximity sensor 38 which is preferably positioned proximate cavity 42. The function of the proximity sensor is to detect the presence of a cigarette in cavity 42. If a cigarette is present, the proximity sensor moves to an electrically closed position thereby enabling electrical current from the power supply to flow to the heating element if all other switches in the circuit are activated. If the proximity sensor does not detect the presence of a cigarette, the sensor remains electrically open and thereby prevents activation of the circuit.

Figure 4:
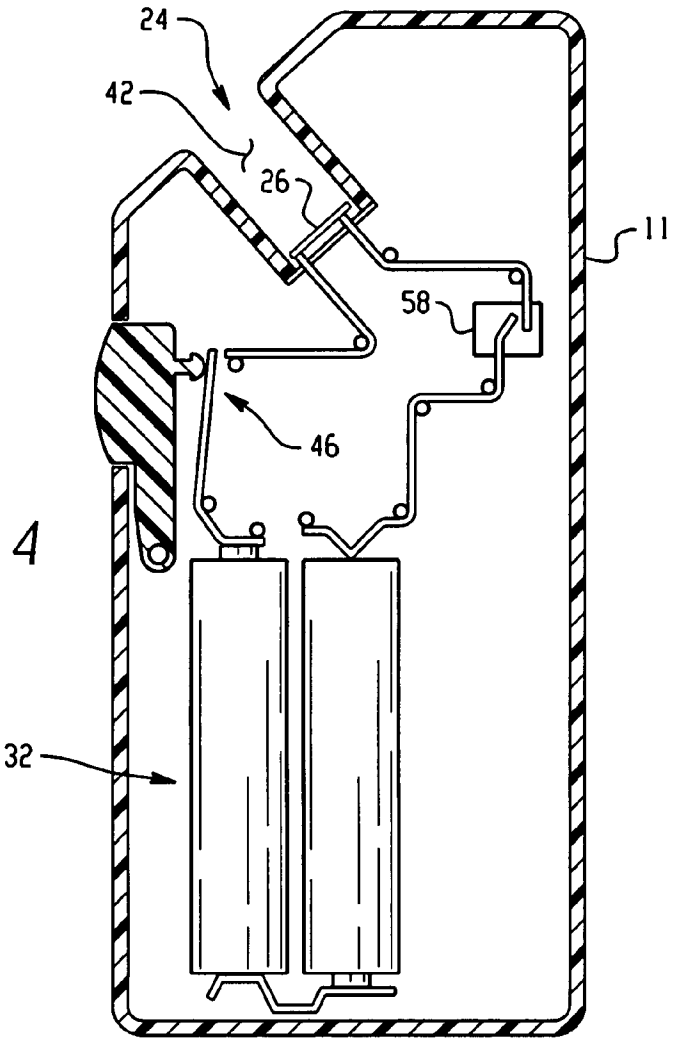
FIG. 4 is a cross-sectional view of a third embodiment of a battery powered cigarette lighter of the present invention.

Shown in FIG. 4 is another embodiment of a cigarette lighter of the present invention. Similar to the embodiment shown in FIG. 1, the lighter shown in FIG. 4 includes a housing 11 with an electrical circuit disposed therein. The housing defines an opening 24. The circuit includes heating element 26, direct current power supply 32 that provides an electrical current to the heating element, a first manually operated switch 46 and an altimeter switch 58 that is activated by a change in air pressure caused by changing the altitude of the lighter. The function of the altimeter switch is to electrically disable the circuit if the altitude of the lighter exceeds a first predetermined elevation. The altitude switch would then form a closed circuit when the lighter was moved below a second predetermined elevation. As soon as the lighter is below the second predetermined elevation, the consumer would be able to ignite a cigarette by pressing first manual switch 28 after inserting the first end of a cigarette into cavity 42. Cigarette lighters with an altimeter switch incorporated therein are particularly useful to travelers who smoke and travel via airplanes where cigarette lighters that generate an open flame are prohibited due to the risk of fire during flight. If desired, the altimeter switch could also be made to inactivate the lighter's circuit if the elevation of the lighter was less than a third predetermined value which is less than the first predetermined value. A cigarette lighter that would not work below a third predetermined value could be used to prevent the lighting of cigarettes in mines that extend far below the earth's surface and from which material such as coal, iron ore and salt are mined. Preventing the ignition of a cigarette far below ground is potentially important due to the potential accumulation of flammable gas in the mine.

Figure 5:
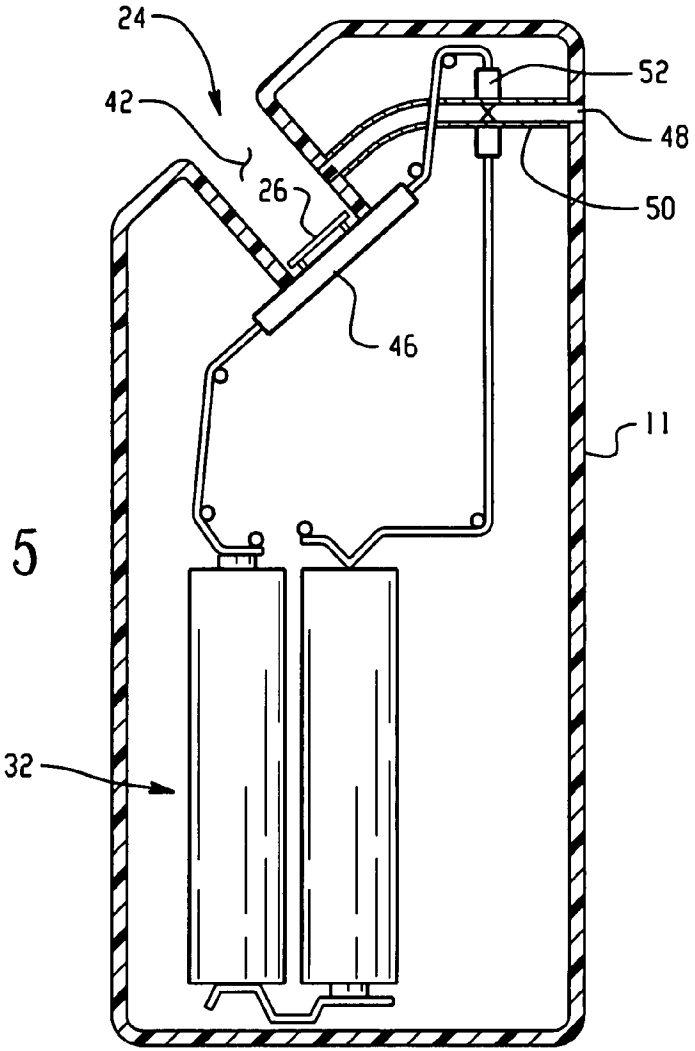
FIG. 5 is a cross-sectional view of a fourth embodiment of a battery powered cigarette lighter of the present invention.

Shown in FIG. 5 is another embodiment of a cigarette lighter of this invention. Similar to the embodiment shown in FIG. 1, the lighter shown in FIG. 5 includes a housing 11 with an electrical circuit disposed therein. The housing defines an opening 24 therein. The circuit includes heating element 26, direct current power supply 32 that provides an electrical current to the heating element and a switch 46 that regulates the flow of electrical current to the heating element. Switch 46 is activated by a change in air flow within the housing. The change in air flow could be a change in the quantity of air flowing through the housing and/or a change in the rate of air flowing through the housing. In this embodiment, air enters the housing via air inlet port 48 and is then channeled along passageway 50 toward cavity 42. An air flow detector 52 is disposed along passageway 50 to detect changes in the quantity, direction or rate of flow of air in the passageway. Upon activation of the air flow detector by an appropriate change in the air flowing through the passageway, electrical current is allowed to pass through the circuit to the heating element provided all other switches in the circuit are electrically closed. Air that flows from the passageway into cavity 42 is drawn from the cavity via the cigarette. The movement of air through the cigarette helps to ignite the cigarette and delivers flavor to the consumer. The quantity, direction and rate of flow of the air past the air flow detector is controlled by the consumer when they inhale.

Figure 6:
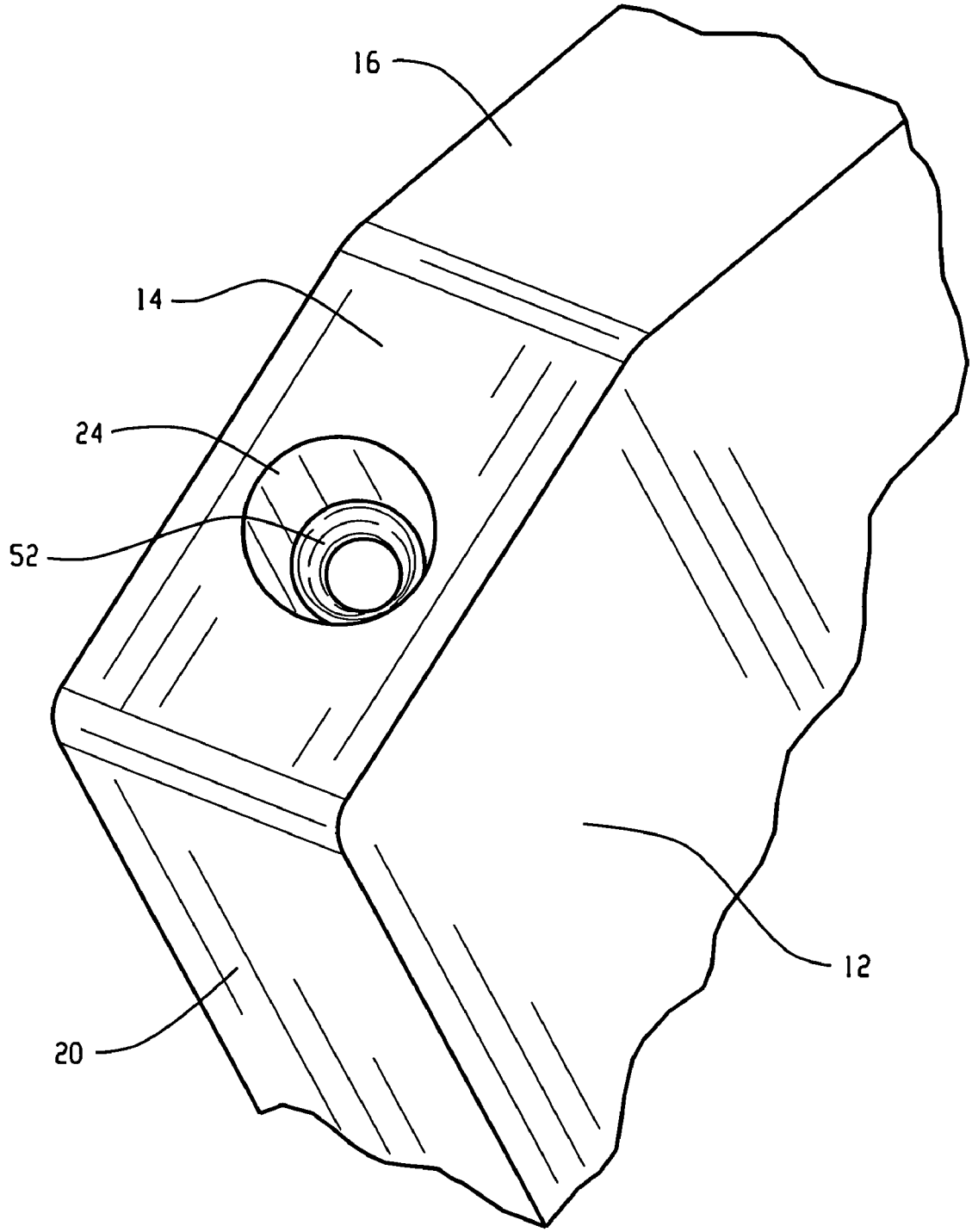
FIG. 6 is a perspective view of the opening in the housing of a battery powered cigarette lighter of the present invention.

Referring now to FIG. 6, the ability of the lighter to respond to either a change in air pressure, as shown in FIG. 1, or a change in air flow, as shown in FIG. 5, can be improved by disposing an air flow restrictor 52 in opening 24. The purpose of the restrictor is to prevent air from entering the cavity by flowing between the outer surface of the cigarette and the inner surface 56 of cavity 42. The restrictor should be made of a flexible material that will create an interference fit against the side of the cigarette thereby preventing the unwanted flow of air into cavity 42. Preferably the interference fit will form essentially a continuous seal around the perimeter of the cigarette. The preferred embodiment utilizes one or more flexible members that cooperate with one another to essentially stop the undesirable movement of air into the cavity when the consumer is inhaling. If an air flow restrictor is not used, air from around the cigarette could flow through the cigarette instead of through the air passageway thereby failing to activate the air flow detector which would cause the air flow detector to remain electrically open thereby preventing the flow of electrical current to the heating coil. Similarly, if an air flow restrictor is not used with a lighter having an air pressure switch, the air flowing around the cigarette and into the cavity might prevent activation of the air pressure switch. Consequently, restricting the influx of air around the cigarette improves the reliability of the air pressure switch and the air flow switch.

Figure 7:
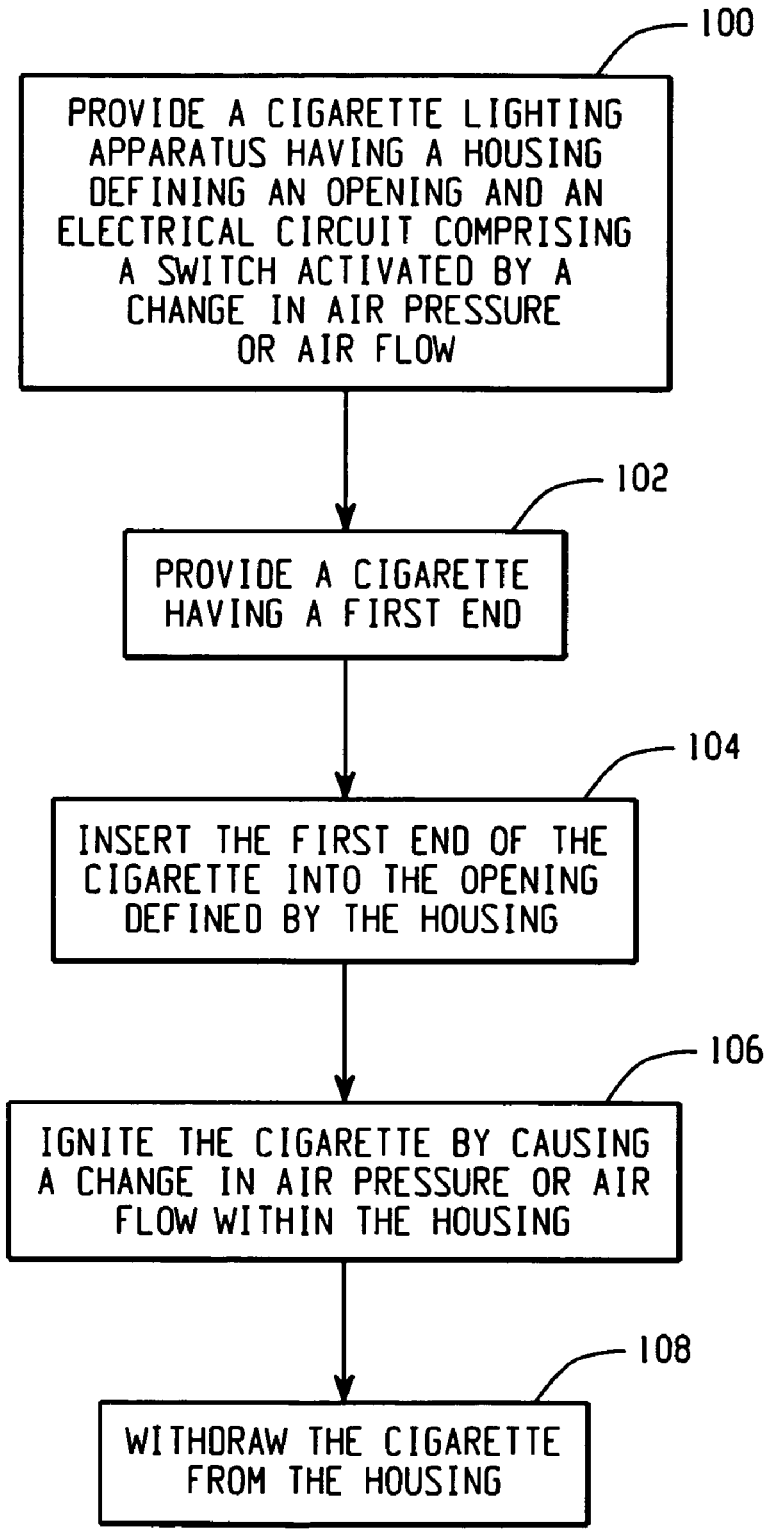
FIG. 7 is a chart showing the steps in a process of this invention.

Referring now to FIG. 7, a consumer that ignites a cigarette according to a process of this invention begins the process by providing in step 100 a cigarette lighting apparatus having a housing that defines an opening therein and an electrical circuit comprising a switch that is activated by a change in air pressure or air flow within the housing. In step 102, a cigarette having a first end and a second end is provided. The first end of the cigarette is inserted into the opening in the housing in step 104. The cigarette is ignited by causing a change in air pressure or air flow within the housing in step 106. The burning cigarette is then withdrawn from the housing in step 108.

The direct current power supply disclosed in FIG. 2 could incorporate a fuel cell or one or more batteries. Suitable batteries may be either rechargeable or nonrechargeable. The battery's anode could be selected from the group consisting of zinc, lithium, cadmium and a metal hydride. Suitable cathode materials include manganese dioxide, nickel hydroxide, nickel oxyhydroxide and iron disulfide. The electrolyte may be aqueous or nonaqueous. A preferred battery contains a lithium anode, a cathode comprising iron disulfide and a nonaqueous electrolyte.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims.

We claim:

1. An apparatus for igniting a cigarette, comprising: a housing and an electrical circuit disposed within said housing; said housing defining an opening therein; said circuit comprising a heating element, a direct current power supply providing an electrical current to said heating element, and a switch for regulating the flow of said electrical current to said heating element, wherein said switch is activated by a change in air pressure within said housing.

2. The apparatus of claim 1 wherein said switch is activated by a reduction in air pressure.

3. The apparatus of claim 1 wherein said switch is activated by an increase in air pressure.

4. The apparatus of claim 1, wherein said circuit comprises an energy storage system and at least a first manually operated switch, wherein said first switch controls the flow of said electrical current to said energy storage system.

5. The apparatus of claim 1, wherein said circuit comprises an energy storage system and at least a first manually operated switch, said first switch controls the flow of said electrical current from said energy storage system.

6. The apparatus of claim 1, wherein said opening in said housing defines one end of a cavity within said housing.

7. The apparatus of claim 1, wherein said direct current power supply comprises at least one battery.

8. The apparatus of claim 1, wherein said housing comprises a means for restricting air flow into said opening.

9. The apparatus of claim 8, wherein said means for restricting air flow is disposed within said cavity.

10. The apparatus of claim 8, wherein said means for restricting air flow comprises one or more flexible members.

11. The apparatus of claim 1, wherein said switch comprises a diaphragm which moves in response to a change in air pressure, said diaphragm's movement activating said switch.

12. The apparatus of claim 1 wherein said switch comprises an altimeter, said altimeter interrupts the flow of said electrical current to said heating element when said apparatus' altitude exceeds a first predetermined value and then allows the flow of said electrical current to resume when said apparatus' altitude is less than a second predetermined value.

13. The apparatus of claim 4 wherein said circuit comprises a second manually operated switch.

14. The apparatus of claim 13 wherein said first switch and said second switch must be activated simultaneously to complete said electrical circuit.

15. The apparatus of claim 1 wherein said circuit comprises a positive temperature coefficient switch.

16. The apparatus of claim 15 wherein said positive temperature coefficient switch limits the flow of said electrical current to said heating element.

17. The apparatus of claim 1 wherein said heating element is accessible to a cigarette via said opening.

18. The apparatus of claim 1 wherein said circuit comprises a proximity switch disposed proximate said opening, said proximity switch capable of detecting the presence of a cigarette in said cavity.

19. The apparatus of claim 1 further includes at least one light emitting diode.

20. The apparatus of claim 19 wherein said light emitting diode illuminates said opening.

21. The apparatus of claim 19 wherein said light emitting diode illuminates the area beyond said housing's opening.

22. The apparatus of claim 7 wherein said battery is rechargeable.

23. The apparatus of claim 7 wherein said battery is not rechargeable.

24. The apparatus of claim 4 wherein said energy storage system comprises at least one component selected from the group consisting of a capacitor, a super capacitor and a rechargeable battery.

25. An apparatus for igniting a cigarette, comprising: a housing and an electrical circuit disposed within said housing; said housing defining an opening therein; said circuit comprising a heating element, a direct current power supply providing an electrical current to said heating element, and a switch for regulating the flow of said electrical current to said heating element, wherein said switch is activated by a change in air flow within said housing.

26. The apparatus of claim 25 wherein said switch is activated by a change in the quantity of air flowing through said housing.

27. The apparatus of claim 25 wherein said air flow activated switch is activated by a change in the rate of air flowing through said housing.

28. The apparatus of claim 25, wherein said circuit comprises an energy storage system and at least a first manually operated switch, said first manually operated switch controls the flow of said electrical current to said energy storage system.

29. The apparatus of claim 25, wherein said circuit comprises an energy storage system and at least a first manually operated switch, said first manually operated switch controls the flow of said electrical current from said energy storage system and wherein said energy storage system comprises at least one component selected from the group consisting of a capacitor, a super capacitor and a rechargeable battery.

30. The apparatus of claim 25, wherein said opening in said housing exposes a cavity within said housing.

31. The apparatus of claim 30, wherein said housing defines a passageway comprising at least one air inlet port, through which air enters said housing, and said opening, through which air exits said housing.

32. The apparatus of claim 25, wherein said housing comprises an air flow restrictor.

33. The apparatus of claim 25, wherein said housing comprises an air flow restrictor disposed within said cavity.

34. The apparatus of claim 33, wherein said air flow restrictor comprises one or more flexible members that partially block the flow of air into said recessed cavity.

35. The apparatus of claim 29 wherein said circuit comprises a second manually operated switch.

36. The apparatus of claim 35 wherein said first switch and said second switch must be activated simultaneously to complete said electrical circuit.

37. The apparatus of claim 25 wherein said switch comprises a means for measuring the quantity of air flow.

38. The apparatus of claim 25 wherein said circuit comprises a positive temperature coefficient switch.

39. The apparatus of claim 38 wherein said positive temperature coefficient switch limits the flow of said electrical current to said heating element.

40. The apparatus of claim 25 wherein said heating element is accessible to a cigarette via said recessed opening.

41. The apparatus of claim 25 wherein said circuit comprises a proximity switch disposed proximate said cavity, said proximity switch detects the presence of a cigarette in said cavity.

42. The apparatus of claim 25 further includes at least one light emitting diode.

43. The apparatus of claim 42 wherein said light emitting diode illuminates said recessed opening.

44. The apparatus of claim 43 wherein said light emitting diode illuminates the area beyond said housing's recessed opening.

45. The apparatus of claim 25 wherein said direct current power supply comprises at least one battery.

46. The apparatus of claim 45 wherein said battery is rechargeable.

47. The apparatus of claim 45 wherein said battery is not rechargeable.

48. The apparatus of claim 25 wherein said cigarette has an elongated shape, a first end, a second end and is permeable to air from said first end to said second end.

* * * * *